United States Patent [19]

Mori et al.

[11] Patent Number: 4,912,010

[45] Date of Patent: Mar. 27, 1990

[54] PROCESS FOR PRODUCING TONER

[75] Inventors: Hiromi Mori, Yokohama; Satoshi Matsunaga, Tokyo; Kuniko Kobayashi, Koganei; Yoshihiko Hyosu, Machida, all of Japan

[73] Assignee: Canon Kabushiki Kaisha, Tokyo, Japan

[21] Appl. No.: 373,699

[22] Filed: Jun. 30, 1989

Related U.S. Application Data

[63] Continuation of Ser. No. 61,127, Jun. 12, 1987, abandoned.

[30] Foreign Application Priority Data

Jun. 16, 1986 [JP] Japan ..... 61-138224

[51] Int. Cl.[4] ..... G03G 9/08

[52] U.S. Cl. ..... 430/157; 430/109; 524/489

[58] Field of Search ..... 430/137, 109; 524/489

[56] References Cited

U.S. PATENT DOCUMENTS

| | | | |
|---|---|---|---|
| 4,457,998 | 7/1984 | Gruber et al. | 430/110 |
| 4,514,487 | 4/1985 | Kasuya et al. | 430/137 |
| 4,592,990 | 6/1986 | Takagi . | |
| 4,601,968 | 7/1986 | Hyosu | 430/137 |
| 4,609,607 | 9/1988 | Takagi et al. | 430/106.6 |
| 4,626,489 | 12/1988 | Hyosu | 430/137 |
| 4,634,651 | 1/1987 | Okawara et al. | 430/114 |

*Primary Examiner*—John L. Goodrow

*Attorney, Agent, or Firm*—Fitzpatrick, Cella, Harper & Scinto

[57] ABSTRACT

A process for producing a toner comprising:

heating a monomer composition containing at least a polymerizable monomer and a release agent to a temperature not lower than the melting point or the softening point of said release agent to dissolve the release agent in the polymerizable monomer and thereby preparing a monomer composition in which the release agent is dissolved;

cooling the monomer composition to a temperature lower than the melting point or the softening point of the release agent to precipitate said release agent and thereby preparing a monomer composition containing the precipitated releasing agent particles having a number average size of 0.5 to 5 μm;

granulating in an aqueous dispersion medium the monomer composition to prepare a particle;

carrying out suspension polymerization of the particle of the monomer composition at a temperature lower than the melting point or the softening point of the release agent.

36 Claims, No Drawings

PROCESS FOR PRODUCING TONER

This application is a continuation of application Ser. No. 061,127, filed June 12, 1987, now abandoned.

BACKGROUND OF THE INVENTION

1. Field of the Invention

The present invention relates to a toner used in an image forming method such as an electrophotography method, an electrostatic recording method and the like, and particularly to a toner suited for heat roller fixing.

2. Related Background Art

A large number of processes have been conventionally known as electrophotographic processes, as disclosed in U.S. Pat. No. 2,297,691, Japanese Patent Publication No. 23910/1967 (U.S. Pat. No. 3,666,363) and Japanese Patent Publication No. 24748/1968 (U.S. Pat. No. 4,071,361). In general, copies are obtained by forming an electric latent image on a photosensitive member utilizing a photoconductive material and according to various means, subsequently developing said latent image by use of a toner to form it into a visible image, and transferring the toner image to a transfer medium such as paper as necessary, followed by fixing by heat or pressure, or heating and pressurization.

Also known are various types of developing processes in which an electrostatic latent image is formed into a visible image by use of a toner. For example, there are such processes as the magnetic brush development disclosed in U.S. Pat. No. 2,874,063, the cascade development disclosed in U.S. Pat. No. 2,618,552, the powder cloud development disclosed in U.S. Pat. No. 2,221,776, the fur brush development and the liquid development.

Also known is a magnetic recording process in which a magnetic latent image is developed by a magnetic toner.

As toners used in these development processes, there has been conventionally used fine powder obtained by dispersing a dye or pigment in a natural or synthetic resin. It is also known to use developing fine powder to which a third component is added for various purposes.

The developed toner image is transferred to a transfer medium such as paper and fixed thereto, as necessary. Known methods of fixing the toner image include a method in which a toner is melt-adhered and hardened on a support by heating and pressurizing the toner by a heat roller, a method in which a toner is heat-melted by use of a heater or a heat roller so as to be melt-adhered and hardened on a support, a method in which a binder resin in a toner is softened or melted by use of an organic solvent and then fixed on a support, and a method in which toner is pressure-fixed on a support.

Materials for toners are selected so as to be suited for the respectively corresponding fixing methods and, in general, a toner used in a particular fixing method can not be used in the other fixing methods. In particular, it is almost impossible to divert a toner used i the widely available heat-melt fixing method employing a heater, to the heat-roller fixing method, the solvent fixing method or the pressure fixing method. Accordingly, there have been studied and developed toners correspondingly suited for the respective fixing methods.

Various methods and apparatus have been developed with respect to the steps of fixing a toner image to paper, and the methods most widely used at present may include the heat-roll fixing method in which heat and pressure is simultaneously applied. The heat-roll fixing method is a method in which an image-receiving sheet supporting a toner image is brought into contact with a heated roller, thereby fixing the toner image on the image-receiving sheet.

However, this fixing method tends to generate an undesirable offset phenomenon in which part of the toner supported on the image-receiving sheet is transferred on the surface of the roller.

As disclosed in Japanese Patent Publication No. 23354/1976 (U.S. Pat. No. 3,941,898), such an offset phenomenon tends to be caused when a low molecular resin is used as a binder resin of a toner. For this reason, as disclosed in this publication, a crosslinked resin has been used as a binder resin, whereby the offset phenomenon is considered to be able to be prevented to a certain extent. As a matter of course, mere employment of the crosslinked resin may result in the increase of the fixing temperature, causing the problem of the low-temperature offset at an unfixed portion, without reaching the level of practical use.

Further, a toner is required also to have, besides the fixing performances, excellent blocking resistance, developing performances, transfer performances, cleaning performances in an appropriate proportion.

Conventionally, the toner used in the heat-roller fixing method has been usually produced by employing a process in which a thermoplastic resin, a coloring agent, a release agent such as polyalkylene, and other additives are melt-mixed and thereafter, after cooling the resulting kneaded material, the cooled material is ground by a finely grinding machine, wherein the ground material is controlled to have a desired particle size distribution by a classifying machine. This production process can produce a considerably superior toner, but may have a certain limit.

In this production process, which requires a grinding step, the cooled kneaded material must be ground at a considerable speed to attain the desired particle size taking account of the productivity and depending on the type of a grinding apparatus. For this reason, it is necessary to use a material having a brittleness high enough to be readily ground by a mechanical force. However, a toner having a high brittleness may be formed into fine particles because it may be readily ground by a load applied to the toner in a developing device, such that it may contaminate a developing sleeve, or may make imperfect by itself the charge control, bringing about undesirable phenomena such as fogging.

When a low melting material is used in order to improve the heat stability of a toner, the resin composition may be melt-adhered to the grinding apparatus, resulting in an extreme lowering of the productivity.

Further, the toner produced by such a production process has disadvantages in that the surface thereof comprises part covered with resin and part on which a pigment is exposed to have an non-uniform surface property, and therefore the distribution of the frictional charge quantity of a toner can not be uniform, or, when a toner is produced by using a low softening or low melting resin as a binder resin in order to improve the fixing performances, the flowability of a toner may be so worsened that the toner can not be applied in practical use. Still further, in the toner obtained by the melt-kneading method, the release agent such as low molecular weight polyalkylene has such poor compatibility with a binder resin in nature that the dispersing state of the release agent can be controlled only with difficulty. The dispersing state of the release agent may vary depending on the temperature, time and share in melt-kneading, and may greatly affect the fixing performances, blocking resistance of a toner. The reason thereof is presumably that the amount of the release agent added in each of the ground toner is different, or that the particle size of the release agent in a toner can be greatly varied. In order for these release agents to be immediately diffused to the surface of a toner at the time of fixing to achieve the release effect, they are essentially required to have poor compatibility with a binder, and it is difficult to obtain a toner having desirable dispersibility by a melt-kneaded material grinding method.

To solve the above various problems, there has been proposed, as disclosed in Japanese Unexamined Patent Publication No. 87051/1981 (U.S. Pat. No. 4,514,487), a process for producing a toner, characterized by carrying out polymerization in the presence of a release agent. According to this process, the release agent present in a monomer during the polymerization step is melted by heat to turn to a liquid, whereby the uniform distribution into the monomer can be surely achieved. However, because of the change in the solubility of the release agent due to the change of the polymerization degree during the polymerization, the state of precipitation may vary with time, and the control of particle size of the release agent can be made with difficulty as in the kneading method, whereupon great non-uniformity can be seen in the fixing performances.

SUMMARY OF THE INVENTION

An object of the present invention is to provide a toner having solved the problems mentioned above.

Another object of the present invention is to provide a toner having good fixing performances and offset resistance.

A further object of the present invention is to provide a toner in which a release agent has been homogeneously dispersed in the inside of toner particles.

Still another object of the present invention is to provide a process for producing a toner obtained by:

(a) a precipitation step of heating a monomer composition containing at least a polymerizable monomer and a release agent to a temperature not lower than the melting point of said release agent, followed by cooling to a temperature lower than the melting point to give particles having a number average size of 0.5 to 5 μm; and (b) a polymerization step of granulating in an aqueous dispersion medium the monomer composition obtained in the precipitation step, and carrying out suspension polymerization at a temperature lower than the melting point of said release agent.

According to the present invention, there is provided a process for producing a toner, comprising:

heating a monomer composition containing at least a polymerizable monomer and a release agent to a temperature not lower than the melting point or the softening point of said release agent to dissolve said release agent in said polymerizable monomer and thereby preparing said monomer composition in which said release agent in dissolved;

cooling said monomer composition to a temperature lower than the melting point or the softening point of said release agent to precipitate said release agent and thereby preparing a monomer composition containing the precipitated releasing agent particles having a number average size of 0.5 to 5 μm;

granulating in an aqueous dispersion medium said monomer composition to prepare a particle;

carrying out suspension polymerization of said particle of the monomer composition at a temperature lower than the melting point or the softening point of said release agent.

DETAILED DESCRIPTION OF THE PREFERRED EMBODIMENTS

In the present invention, the polymerization of a monomer is carried out in the state that the release agent particle having certain grain size has been homogeneously dispersed in the monomer composition at the former stage of the polymerization step. In the step of carrying out the polymerization, the polymerization is usually initiated by a polymerization initiator. In general, heating of the monomer composition is carried out to a temperature suited for the polymerization initiator to be used. In the present invention, the polymerization is carried out within the temperature range that the change in grain size due to the re-melting of the release particle agent dispersed in the monomer composition may not matter in the practical use, whereby the dispersed release agent particle may be incorporated into the toner without any change substantially in the particle size thereof. In the polymerization step, the heating up to the temperature at which the re-melting of the dispersed release agent particle may cause the change in the grain diameter thereof, resulting in no desired toner obtained.

In general, the release agent used in a toner has poor compatibility with a binder resin, and is present as particles in the continuous phase of the binder resin, and is melted by heat added at the time of fixing. The release agent usually used is one having a much smaller molecular weight and lower melt viscosity as compared with the binder resin, and therefore it is possible to prevent the so-called offset phenomenon that a toner is transferred to a fixing roller since the release agent is diffused on the toner surface during fixing by a heat fixing roller.

To regulate the grain size of the release agent to be used, it can be considered to regulate it by grinding with use of a grinder (for example, by freezing the release agent and grinding the freezed release agent) and classifying the resulting ground material. However since the production cost tends to become higher and formation of fine particles can be achieved only with difficulty, this method is not more preferable than the method of the present invention. It can be also considered to dissolve the release agent with use of a solvent capable of dissolving the release agent, and effect precipitation by adding a poor solvent. However, this method is not desirable since the step of removing the solvent is required, causing the cost to become higher, and the agglomeration tends to occur at the time of so as to require a step of loosening the agglomeration material. In the regulating method of the release agent particle employed in the present invention, the release agent is added in the monomer liquid, followed by heating, so that the release agent is dissolved and then the monomer liquid is cooled to precipitate the release agent as fine particles. No removal of the solvent is required, and a homogeneous dispersion system of the release agent can be obtained without any problem of the agglomaration to be accompanied with the drying. In such a method, the grain size in the formation of fine particles may be regulated by controlling the amount of the release agent added in the monomer, the stirring and cooling rates at the time of the precipitation, etc.

It is preferred to add the release agent in a smaller amount, but, in order to achieve the offset preventive effect large enough as a toner, in an amount of 1% by weight or more, preferably from 2% by weight to 30% by weight (preferably 20% by weight or less). The release agent may also be used in a diluted form by adding a monomer to the resulting system.

It is also preferred to carry out stirring at the time of the precipitation, and there can be used a known stirrer, preferably a stirrer of a turbine stator type high-shear type. In the case of use of the stirrer, the preferable rotation rate is from 3,000 to 7,000 r.p.m.

It is preferred for the cooling rate at the time of the precipitation to be higher, but this can be compensated for by stirring. The cooling rate is 2° C./min. or more (preferably, 3°~8° C./min).

In the case where a resin having a polar group is used by adding it in the monomer composition, a resin that may be dissolved at a temperature lower than the dissolving temperature of the release agent can be added after precipitation of the release agent, but a resin requiring higher temperature than that may be used by dissolving it before addition of the release agent. Alternatively, a solution in which the other resin in dissolved in a monomer and the solution added to a monomer liquid containing a release agent particle system.

The precipitation step of a release agent may be carried out in the presence of a coloring agent contained in a monomer composition.

After the precipitation, the release agent may desirably has a particle size of 0.5 to 5 μm (preferably, 0.5–4 μm) in terms of the number average diameter. The size greater than 5 μm (number average diameter) may make it difficult, at the time of fixing, to achieve uniform diffusion of the release agent to the whole area of the toner by the melting of the release agent, and may cause a change in the fixing performances and/or offset resistance. A size greater than 5 μm may also make it difficult to achieve homogeneous dispersion in the monomer system, and tends to give ununiform content of the release agent in the respective toner particles, resulting in the difference in the fixing performances and offset resistance due to the difference in the content. The size smaller than 0.5 μm may result in overly high thixotropic properties of the monomer composition to make broad the grain size distribution of the toner undesirably.

The release agent used in the present invention may include polyolefin waxes, paraffin waxes, aliphatic acids, aliphatic acid amides, and aliphatic acid esters. Among them, polyolefin waxes are preferable in the present invention. As the polyolefin waxes, desirable are those having a weight average molecular weight of 1,000 to 20,000, preferably 2,000 to 7,000, and a melting point (JISK2235-5.3.1.) or a softening point (JISK2531-1960) of 100° to 170° C., preferably 100° to 160° C. Such polyolefin waxes may include polyethylene, polypropylene, and propylene-ethylene copolymer.

These release agents can be used alone or in combination, and may be used in an amount of 1 part to 30 parts by weight, preferably 2 to 20 parts by weight, based on 100 parts by weight of the polymerizable monomer.

In the present invention, in order to prevent the remelting of the release agent particle, polymerization is carried out at a temperature lower than the melting point or the softening point of the release agent to be used. Preferably, it is carried out at a temperature 20° C. or more lower than the melting point or the softening point.

Any type of polymerization initiators may be used as the polymerization initiator in the above procedures, but, in order for the polymerization to be carried out in a good state, it is desirable to use those wherein the temperature at which the half-life of the polymerization initiator is 100 to 500 minutes is lower than the melting point or softening point of the release agent, preferably 20° C. or more lower than the melting point or the softening point.

The polymerizable monomer applicable in the present invention may include vinyl type monomers having

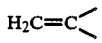

such as styrenes and derivatives thereof such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylenically unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate, vinyl benzoate; α-methylene aliphatic monocarboxylic acid esters such as methyl methacrylate, ethyl mathacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaninoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrol, N-vinylcarbazole, N-vinylindole and N-vinylpyrrolidone; vinylnaphthalenes; and acrylic acid or methacrylic acid derivatives such as acrylonitrile, methacrylonitrile and acrylamide. Among them, styrene monomers, acrylic acid ester monomers and methacrylic acid ester monomers are preferable.

The monomers may be polymerized by adding as an additive polymer, a copolymer having a polar group or cyclized rubber having a polar group.

In the present invention, polymerization is preferably carried out by suspending a polymerizable monomer composition to which the polymer, copolymer having a polar group or cyclized rubber having a polar group has been added, in an aqueous phase in which said polar polymer and a reverse chargeable dispersant have been dispersed. More specifically, a cationic or anionic polymer, a cationic or anionic copolymer or cyclized rubber contained in a copolymerizable monomer composition and a reverse chargeable anionic or cationic dispersant are electrostatically attracted to each other on the surface of toner-forming particles in the course of the polymerization reaction, so that the particle surfaces are covered with the dispersant, whereby the coalescence between particles can be prevented and particles can be made stable, and also, the polar polymer added at the time of the polymerization gathers at the surface layer portion of each toner-forming particle, so that a sort of shell is formed thereon and the resulting particle resembles a capsule. Polymerization is carried out in the manner that use of the polar polymer, polar copolymer or cyclized rubber having a relatively high molecular weight can impart excellent properties such as blocking resistance, developing performance and abrasion resistance to the toner particles. Further, polymerization is carried out such that, in the inside of the particle, the one having a relatively low molecular weight can contribute to the improvement in the fixing performance, whereby there can be obtained a toner that can satisfy the conflicting requirements, i.e., the fixing performance and the blocking resistance.

The polar polymer (including polar copolymers) and reverse chargeable dispersant that can be used in the present invention are exemplified in the following:

(i) The cationic, polymer may include polymers of nitrogen-containing vinyl type monomers such as dimethylaminoethyl methacrylate, diethylaminoethyl methacrylate, dimethylaminoethyl acrylate, diethylaminoethyl acrylate, or copolymers of styrene, unsaturated carboxylic acid esters or the like with said nitrogen-containing monomers.

(ii) The anionic polymer may include a polymer or copolymer of monomer selected from the group consisting of nitrile monomers such as acrylonitrile, halogen-containing monomers such as vinyl chloride, unsaturated carboxylic acids such as acrylic acid, unsaturated dibasic acids, anhydrides of unsaturated dibasic acids or nitro monomers cyclized rubber or polyester resins, etc.

(iii) The anionic dispersant may include water soluble macromolecules such as partially saponified products of vinyl acetate type polymers, or colloidal silica such as Aerosil #200, #300, etc. (available from Japan Aerosil Co.).

(iv) The cationic dispersant may include hydrophilic regular chargeable silica fine powder such as aluminum oxide, magnesium oxide, aminoalkyl modified colloidal silica, etc. Cyclized rubber may be used in place of the polar polymers.

As the coloring agent usable in the present invention, substances magnetizable when placed in a magnetic field can be also used, including, for example, powder of ferromagnetic metals such as iron, cobalt and nickel, or powder of alloys or compounds such as magnetite, hematite and ferrite. Magnetic fine particles having a particle diameter of 0.05 to 5 μm, preferable 0.1 to 1 μm, may be used. The magnetic fine particles may be contained in an amount of 10 to 60% by weight, preferably 25 to 50% by weight, based on the toner weight. These magnetic fine particles may also have been treated with a treatment agent such as a silane coupling agent and a titanium coupling agent, or other suitable reactive resins. In this instance, though depending on the surface area of the magnetic fine particles and the density of hydroxyl groups present on the surface, sufficient dispersibility can be attained with a treatment amount of 5 wt. % or less, without any ill influences on the properties of the toner.

If necessary, a charge controlling agent, a coloring agent and a fluid modifier may be added in the toner. The charge controlling agent and the fluid modifier may be used by mixing into (or externally adding to) the toner particles. The charge controlling agent may include metal-containing dyes or Nigrosine. The coloring agent that can be used may include conventionally known dyes or pigments. The coloring agent is 0.5–20 parts by weight based on 100 parts by weight of a monomer. The fluid modifier may include colloidal silica or aliphatic acid metal salts.

A fluidity improver such as Teflon fine powder, vinylidene fluoride resin fine powder may further be compounded for the purpose of preventing the agglomeration between toner particles and thereby improving the fluidity.

As for the polymerization initiator, the radical-generating agents may be used. The polymerization of the vinyl type monomer can be carried out with use of any suitable polymerization initiators including, for example, azobisisobutylnitrile (AIBN), 2,2'-azobis(2,4-dimethylvaleronitrile, benzoyl peroxide, methyl ethyl ketone peroxide, isopropyl peroxycarbonate, cumene hydroperoxide, 2,4-dichlorylbenzoyl peroxide, lauroyl peroxide, etc. In general, the initiator can be sufficient in an amount of about 0.5 to 10 wt. %, preferably about 0.5 to 5 wt. %, based on the weight of the monomer.

In polymerization of a polymerizable monomer, the crosslinking agent as shown below may be present to carry out the polymerization to give a crosslinked polymer having two or more vinyl groups.

There can be appropriately used any of the crosslinking agents used, including divinyl benzene, divinyl naphthalene, divinyl ether, divinyl sulfone, diethylene glycol dimethacrylate, triethylene glycol dimethacrylate, ethylene glycol dimethacrylate, polyethylene glycol dimethacrylate, diethylene glycol diacrylate, triethylene glycol diacrylate, 1,3-butylene glycol dimethacrylate, 1,6-hexane glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetracrylate, dibromoneopentyl glycol dimethacrylate, allylphthalate, etc.

In the case of crosslinking agents used in an overly large amount, the toner may not be melted during heat roller fixing to make poor the fixing. Also, crosslinking agents used in an overly small amount may worsen blocking resistance and durability necessary for the toner, and may make it harder to prevent the offset phenomenon such that, in heat-roll fixing, part of the toner is not perfectly fixed to paper, is adhered on the surface of a roller, and is transferred to the next paper. Accordingly, these crosslinking agents may be preferably used in an amount of 0.001 to 15% by weight, more preferably 0.1 to 10% by weight, based on the total amount of the toner.

The aqueous dispersion medium may be any of those obtained by incorporating any suitable stabilizers, for example, any one or a mixture of polyvinyl alcohol, gelatin, sodium salts of methyl cellulose, methyl hydropropyl cellulose, ethyl cellulose or carboxymethyl cellulose, polyacrylic acids and salts thereof, starch, gum alginate, zein, casein, tetracalcium phosphate, talc, barium sulfate, bentonite aluminum hydroxide, ferric hydroxide, titanium hydroxide, thorium hydroxide, etc.

These stabilizers may be used in an amount required for the stabilization in the aqueous phase, preferably in the range of about 0.1 to 10% by weight.

For the fine dispersion of the above inorganic dispersant, a surface active agent may be also used within the range of 0.001 to 0.1% by weight. This is used for promoting the desired action of the above dispersion stabilizers, and may specifically include sodium dodecylbenzenesulfonate, sodium tetradecylsulfate, sodium pentadecylsulfate, sodium octylsulfate, sodium allyl-alkyl-polyether sulfonate, sodium oleate, sodium laurate, sodium caprate, sodium caprylate, sodium caproate, potassium stearate, calcium oleate, sodium 3,3-disulfonediphenylurea-4,4-diazo-bis-amino-8-naphthol-6-sulfonate, orthocarboxybezene-azo-dimethylaniline, sodium 2,2,5,5-tetramethyl-triphenylmethane-4,4-diazo-bis-β-naphthol-disulfonate. Moreover, in the case of use of the stabilizers, attention should be paid to the point that the humidity resistance tends to lower.

A readily water-soluble monomer may simultaneously undergo emulsification polymerization in water and may contaminate the resulting suspension polymerized product with small particles formed by emulsification polymerization. Accordingly, a water soluble polymerization inhibitor, for example, a metal salt, may be preferably added to prevent the emulsification polymerization in an aqueous phase. Also, in order to prevent the coalescence of particles by increasing the viscosity of the medium, glycerol, glycol or the like may be preferably added to water. In order also to decrease the solubility of the readily soluble monomer to the water, salts such as NaCl, KCl and $Na_2SO_4$ can be used.

To granulate the monomer composition in the aqueous dispersion medium, there may be used, for example, a homomixer comprising a high speed revolving turbine and a stator, a homogenizer, etc. for the granulation of the monomer composition. In general, the stirring rate and time may be controlled so that the monomer composition may have the size of 30 μm or less. The revolution number may be preferably used so as to be 10 to 30 m/sec of peripheral speed of the turbine. There is no particular limitation in the granulation time, but it may be preferably 5 to 60 minutes. The ratio of the monomer composition to the aqueous dispersion medium may be preferably such that 200 to 3,000 parts by weight of the aqueous dispersion medium are used based on 100 parts by weight of the monomer composition.

The stirring at the time of the polymerization may be carried out to such an extent that sedimentation of the particles can be prevented so that the dispersed state attained by the action of the dispersion stabilizer can be substantially maintained. The polymerization may be carried out for the period during which the polymerization can be completed, preferably for 2 to 24 hours.

The resulting particles are subjected to removal of the dispersant by treatment with acid or alkali or any other means, or by washing or the like without such a treatment, filtered and dried to obtain a toner. When it is unnecessary to remove the dispersant, the particles may be filtered and dried as they are, to obtain the toner. Thereafter, if necessary, finer powder without the standard grain size may be removed by means of an air classification machine.

To the toner of the present invention, carbon black, Nigrosine, metal-containing complex salts, colloidal silica powder fluorine resin powder, etc. may be added for the purpose of charge control or prevention of agglomeration.

The toner of the present invention can be applied in various developing processes. Such processes may include, for example, the magnetic brush development, the cascade development, the process in which a conductive magnetic toner is used as disclosed in U.S. Pat. No. 3,909,258, the process in which a highly resistant magnetic toner is used as disclosed in Patent Laid Open Application No. 31136/1978, the processes as disclosed in Patent Laid Open Application No. 42141/1979, No. 18656/1980, etc. the fur brush development, the powder cloud development, the impression development, and so forth.

The toner image formed on a fixing sheet such as paper by using the toner of the present invention can be fixed by means of a heat roller without causing any offset phenomenon even with use of a fixing roller, on the surface of which any offset preventive liquid is not fed. As the fixing roller, there can be used one having a smooth surface whose surface has been formed by fluorine resins such as Teflon (available from DuPont Co.), Fluon (available from ICI Inc.) and Kel-F (available from 3M Company), silicone rubber or silicone resin, or, in some cases, the one having a metallic surface.

EXAMPLE 1

In a container, 170 parts by weight of styrene monomer and 8.4 parts by weight of a low molecular polyethylene (Sunwax 151-P, softening point, 107° C.; available from Sanyo Chemical Industries, Ltd.) were heated at 110° C. and dissolved. With stirring (3,000–4,000 r.p.m) by use of TK homomixer (available from Tokushyu Kikai Kogyo Co., Ltd.), the content was cooled down to 70° C. (cooling rate, 6° C./min) and the low molecular polyethylene was precipitated to prepare a stylene monomer liquid containing a low molecular polyethylene particle. Part thereof was taken out to remove monomers at a low temperature by use of a vacuum dryer, and the particle diameter of the resulting finely particulate polyethylene was measured by use of a Coulter counter, to reveal that it was 2.5 μm in the number average diameter.

Added to 178.4 parts by weight of the stylene monomer liquid was a 70° C. solution obtained by dissolving 20 parts by weight of a styrene/dimethylaminoethyl methacrylate copolymer (monomer ratio (copolymerization weight ratio): 9:1; $\overline{Mn}=20,000$) in 30 parts by weight of 2-ethylhexyl acrylate monomer.

Subsequently, 140 parts by weight of a magnetic material [3% KR-TTS-treated BL-250 (available from Titan Kogyo K.K.) and 2 parts by weight of NK ester 4G (devinyl type crosslinking agent) (Shin-Nakamura Chemical Co., Ltd.) were added and dispersed with stirring. Next, 6 parts by weight of azobisisobutylonitrile (polymerization initiator) were added to prepare a monomer system.

The above monomer composition was introduced in a liquid formed by dispersing 10 parts by weight of Aerosil #200 (available from Japan Aerosil Co.) in 1,000 parts by weight of water with use of TK homomixer and kept at 70° C., and the mixture was stirred at 7,000 r.p.m. for 15 minutes, followed by stirring with paddle blade mixing to effect polymerization for 10 hours. Thereafter, after removal of silica by treating with NaOH, the mixture was washed with water, filtered, and dried to give fine particles having a volume average diameter of 12 μm. To 100 parts by weight of this fine particles, 0.4 part by weight of Nipsil E (wet type silica fine particle) (available from Nippon Silica Industrial Co., Ltd.) was added to give a toner.

This toner was applied in a commercially available copying machine (fixing condition; total pressure 5.7 Kg±0.3, nip width 2–3 mm, temperature 180°±3°) and 2,000 sheets of image reproduction were made. As a result, there were obtained good images without any offset.

EXAMPLE 2

The precipitation step in Example 1 was repeated, except that a low molecular polypropylene (Biscoal 550-P, softening point 150° C.; available from Sanyo Chemical Industries, Ltd.) was used as a release agent in place of the low molecular polyethylene (Sunwax 151-P), the dissolution was carried out at 150° C. and cooling was carried out at cooling rate 5° C./min, whereupon the number average diameter of the resulting finely particulate polypropylene was found to be 3.3 μm. Following thereafter the same procedures in Example 1, a toner was produced and 2,000 sheets of image reproduction were made. As a result, there were obtained good images without any offset.

COMPARATIVE EXAMPLE 1

A low molecular polyethylene (Sunwax 151-P) was freeze-ground to obtain finely particulate low molecular polyethylene having the number average diameter 8 μm. Next, 170 parts by weight of styrene monomer, 30 parts by weight of 2-ethylhexyl acrylate monomer, 20 parts by weight of a styrene/dimethylaminomonomer, ethyl methacrylate copolymer (monomer ratio (copolymerization weight ratio): 9:1; $\overline{M}n=20,000$), 8.4 parts by weight of the above polyethylene fine particle, 2 parts by weight of NK ester 4G (divinyl type crosslinking agent and 140 parts by weight of a magnetic material [3% KR-TTS-treated BL-250 (available from Titan Kogyo K.K.) were heated to 70° C. and subjected to the same procedures as in Example 1 to give a toner. Image reproduction was made in the same manner as in Example 1, but, there was seen curling of paper due to the adhesion of toner to the roller, and contamination of images due to the offset.

As described in the foregoing, the present invention can obtain a toner in which the release agent has been homogeneously dispersed, to have good fixing performances and offset resistance.

What is claimed is:

1. A process for producing a toner, comprising the steps of:

heating a monomer composition without a polymerization initiator, said composition comprising a polymerizable monomer and a polyolefin wax and being heated to a temperature of at least the melting or softening point of said polyolefin wax so as to dissolve said polyolefin wax in said polymerizable monomer, thereby preparing a monomer composition in which said polyolefin wax is dissolved;

cooling said monomer composition to a temperature which is lower than the melting or softening point of said polyolefin wax while stirring said monomer composition with a high-shear stirrer so as to precipitate said polyolefin wax and prepare a monomer composition containing precipitated polyolefin wax particles which have a number average particle size of 0.5 to 5 μm;

mixing the cooled monomer composition with a polymerization initiator;

granulating said monomer composition in an aqueous dispersion medium to prepare a particle;

suspension polymerizing said particle of the monomer composition at a lower temperature than the melting or softening point of said polyolefin wax.

2. A process according to claim 1, wherein the polyolefin wax has a melting point or softening point of 100°–170° C., and the monomer composition is heated to a temperature for dissolving the polyolefin wax.

3. A process according to claim 2, wherein the monomer composition in which the polyolefin wax is dissolved is cooled to a temperature at least 20° C. lower than the melting point or softening point of the polyolefin wax to precipitate the polyolefin wax particle.

4. A process according to claim 1, wherein the polyolefin wax is added in an amount of 1–30 parts by weight based on 100 parts by weight of the polymerizable monomer.

5. A process according to claim 1, wherein the polyolefin wax is added in an amount of 2–30 parts by weight based on 100 parts by weight of the polymerizable monomer.

6. A process according to claim 4, wherein the polymerization initiator has a half life of 100–500 min. in the condition of a temperature lower than the melting point or softening point of the polyolefin wax.

7. A process according to claim 1, wherein the polyolefin wax is added in an amount of 2–20 parts by weight based on 100 parts by weight of the polymerizable monomer.

8. A process according to claim 1, wherein the polymerizable monomer is a vinyl type monomer.

9. A process according to claim 8, wherein the polymerizable monomer is a styrene monomer, an acrylic acid ester monomer or a methacrylic acid ester monomer.

10. A process according to claim 1, wherein the monomer composition contains a polymer having a polar group or an copolymer having a polar group.

11. A process according to claim 1, wherein the monomer composition contains a cyclized rubber.

12. A process according to claim 10, wherein the polymer having a polar group is a cationic polymer formed from a nitrogen-containing vinyl type monomer.

13. A process according to claim 10, wherein the copolymer having a polar group is a cationic copolymer formed from a nitrogen-containing vinyl type monomer, a styrene monomer or an unsaturated carboxylic acid ester.

14. A process according to claim 10, wherein the polymer or copolymer having a polar group is an anionic polymer or anionic copolymer.

15. A process according to claim 14, wherein the polymerization initiator is a radical-generating agent selected from the group consisting of azobisisobutylnitrile (AIBN), 2,2'-azobis(2,4-dimethylvaleronitrile, benzoyl peroxide, methyl ethyl ketone peroxide, isopropyl peroxycarbonate, cumene hydroperoxide, 2,4-dichlorylbenzoyl peroxide and lauroyl peroxide.

16. A process according to claim 15, wherein the polymerization initiator is used in an amount of 0.5–10 wt. % based on a polymerizable monomer.

17. A process according to claim 15, wherein the polymerization initiator is used in amount of 0.5–5 wt. % based on a polymerizable monomer.

18. A process according to claim 1, wherein the monomer composition contains a crosslinking agent.

19. A process according to claim 18, wherein the crosslinking agent is a divinyl type crosslinking agent.

20. A process according to claim 1, wherein the monomer composition in which the polyolefin wax is dissolved is cooled at the cooling rate of 2° C./min. or more.

21. A process according to claim 20, wherein the monomer composition is cooled in the stirring condition of 3,000–7,000 r.p.m. by a stirrer of a high-shear type.

22. A process for producing a binder resin containing polyolefin wax, comprising the steps of:

heating a monomer composition without a polymerization initiator, said composition comprising a polymerizable monomer and a polyolefin wax and being heated to a temperature of at least the melting or softening point of said polyolefin wax so as to dissolve said polyolefin wax in said polymerizable monomer, thereby preparing a monomer composition in which said polyolefin wax is dissolved;

cooling said monomer composition to a temperature which is lower than the melting or softening point of said polyolefin wax, while stirring said monomer composition with a high-shear stirrer, so as to precipitate said polyolefin wax and prepare a monomer composition containing precipitated polyolefin wax particles which have a number average particle size of 0.5 to 5μm;

mixing the cooled monomer composition with a polymerization initiator;

granulating said monomer composition in an aqueous dispersion medium to prepare a particle;

suspension polymerizing said particle of the monomer composition at a lower temperature than the melting or softening point of said polyolefin wax.

23. A process according to claim 22, wherein the polyolefin wax has a melting point or softening point of 100°–170° C., and the monomer composition is heated to a temperature for dissolving the polyolefin wax.

24. A process according to claim 23, wherein the monomer composition in which the polyolefin wax is dissolved is cooled to a temperature at least 20° C. lower than the melting point or softening point of the polyolefin wax to precipitate the polyolefin wax particle.

25. A process according to claim 22, wherein the polyolefin wax is added in an amount of 2–30 parts by weight based on 100 parts by weight of the polymerizable monomer.

26. A process according to claim 22, wherein the polymerization initiator has a half life of 100–500 min. in the condition of a temperature lower than the melting point or softening point of the polyolefin wax.

27. A process according to claim 22, wherein the polyolefin wax is added in an amount of 2–20 parts by weight based on 100 parts by weight of the polymerizable monomer.

28. A process according to claim 22, wherein the polymerizable monomer is a vinyl type monomer.

29. A process according to claim 28, wherein the polymerizable monomer is a styrene monomer, an acrylic acid ester monomer or a methacrylic acid ester monomer.

30. A process according to claim 22, wherein the polymerization initiator is a radical-generating agent selected from the group consisting of azobisisobutyronitrile (AIBN), 2,2'-azobis(2,4-dimethylvaleronitrile, benzoyl peroxide, methyl ethyl ketone peroxide, isopropyl peroxycarbonate, cumeme hydroperoxide, 2,4-dichloryl-benzoyl peroxide and lauroyl peroxide.

31. A process according to claim 30, wherein the polymerization initiator is used in an amount of 0.5–10 wt. % based on a polymerizable monomer.

32. A process according to claim 31, wherein the polymerization initiator is used in an amount of 0.5–5 wt. % based on a polymerizable monomer.

33. A process according to claim 22, wherein the monomer composition contains a crosslinking agent.

34. A process according to claim 33, wherein the crosslinking agent is a divinyl-type crosslinking agent.

35. A process according to claim 22, wherein the monomer composition in which the polyolefin wax is dissolved is cooled at the rate of 2° C./min or more.

36. A process according to claim 35, wherein the monomer composition is cooled while being stirred at 3,000–7,000 r.p.m.

* * * * *

UNITED STATES PATENT AND TRADEMARK OFFICE

CERTIFICATE OF CORRECTION

PATENT NO. : 4,912,010

DATED : March 27, 1990

INVENTOR(S) : Mori, et al.

It is certified that error appears in the above-identified patent and that said Letters Patent is hereby corrected as shown below:

Title page:

[56] References Cited

Under U.S. PATENT DOCUMENTS

"4,592,990 6/1986 Takagi" should read
--4,592,990 6/1986 Takagi et al.--.

"4,609,607 9/1988 Takagi et al." should read
--4,609,607 9/1986 Takagi et al.--.

"4,626,489 12/1988 Hyosu" should read
--4,626,489 12/1986 Hyosu--.

[57] ABSTRACT

Line 12, "said" should read --the--.

COLUMN 1:

Line 59, "i" should read --in--.

COLUMN 2:

Line 1, "is" should read --are--.

COLUMN 3:

Line 66, "in dissolved;" should read --is dissolved;--.

UNITED STATES PATENT AND TRADEMARK OFFICE

CERTIFICATE OF CORRECTION

PATENT NO. : 4,912,010

DATED : March 27, 1990

INVENTOR(S) : Mori, et al.

It is certified that error appears in the above-identified patent and that said Letters Patent is hereby corrected as shown below:

COLUMN 4:

Line 49, "freezed" should read --frozen--.

Line 59, "the" (second occurrence) should be deleted.

Line 60, "of so" should read --of drying so--.

COLUMN 5:

Line 1, "agglomaration" should read --agglomeration--.

Line 30, "in dissolved" should read --is dissolved--.

Line 36, "may" should be deleted.

COLUMN 6:

Line 37, "ethyl matha-" should read --ethyl metha- --.

Line 42, "diethylaninoethyl" should read --diethylaminoethyl--.

COLUMN 7:

Line 26, "cationic," should read --cationic--.

Line 39, "monomers" should read --monomers,--.

UNITED STATES PATENT AND TRADEMARK OFFICE

CERTIFICATE OF CORRECTION

PATENT NO. : 4,912,010

DATED : March 27, 1990

INVENTOR(S) : Mori, et al.

It is certified that error appears in the above-identified patent and that said Letters Patent is hereby corrected as shown below:

COLUMN 9:

Line 15, "orthocarboxybezene-azo-dimethylaniline," should read --orthocarboxybenzene-azo-dimethylaniline,--.

Line 66, "silica powder" should read --silica powder,--.

COLUMN 10:

Line 35, "stylene" should read --styrene--.

Line 43, "stylene" should read --styrene--.

Line 52, "(devinyl" should read --(divinyl--.

Line 68, "this" should read --these--.

COLUMN 11:

Line 31, "styrene/dimethylaminomonomer," should read --styrene/dimethylamino- --.

UNITED STATES PATENT AND TRADEMARK OFFICE

CERTIFICATE OF CORRECTION

PATENT NO. : 4,912,010 Page 4 of 4

DATED : March 27, 1990

INVENTOR(S) : Mori, et al.

It is certified that error appears in the above-identified patent and that said Letters Patent is hereby corrected as shown below:

COLUMN 12:

Line 23, "claim 4," should read --claim 1,--.

Line 54, "claim 14," should read --claim 1,--.

Line 65, "amount" should read --an amount--.

Signed and Sealed this

Third Day of September, 1991

*Attest:*

HARRY F. MANBECK, JR.

*Attesting Officer*

*Commissioner of Patents and Trademarks*